US008142136B2

(12) United States Patent
Li

(10) Patent No.: US 8,142,136 B2
(45) Date of Patent: Mar. 27, 2012

(54) OIL-SEALING ARRANGEMENT FOR COOLING FAN

(75) Inventor: Hong-Guang Li, Sinjhuang (TW)

(73) Assignee: Asia Vital Components Co., Ltd., Taipei County (TW)

( * ) Notice: Subject to any disclaimer, the term of this patent is extended or adjusted under 35 U.S.C. 154(b) by 980 days.

(21) Appl. No.: 12/124,498

(22) Filed: May 21, 2008

(65) Prior Publication Data

US 2009/0290975 A1 Nov. 26, 2009

(51) Int. Cl.
*F01D 25/16* (2006.01)

(52) U.S. Cl. ..... 415/111; 415/170.1; 415/229; 416/174; 417/423.12; 310/90

(58) Field of Classification Search ..... 415/111, 415/170.1, 229; 416/174; 417/423.12; 310/90
See application file for complete search history.

(56) References Cited

U.S. PATENT DOCUMENTS 5,441,386 A * 8/1995 Hsieh ..... 415/230
6,010,318 A * 1/2000 Li ..... 417/423.13
6,055,946 A 5/2000 Dombek et al.
6,318,976 B1 * 11/2001 Hsieh ..... 417/423.12
6,544,011 B2 * 4/2003 Hsieh ..... 417/423.7
6,616,422 B2 * 9/2003 Hsieh ..... 417/354
6,707,199 B2 * 3/2004 Chou et al. ..... 310/90
7,364,400 B2 * 4/2008 Ku et al. ..... 415/111
7,654,796 B2 * 2/2010 Yeh et al. ..... 416/174
2007/0176504 A1 * 8/2007 Otsuki et al. ..... 310/90.5

* cited by examiner

*Primary Examiner* — Igor Kershteyn

(57) ABSTRACT

An oil-sealing arrangement for cooling fan includes a fan housing provided with a central hollow pipe having a hollow bearing fitted therein in a clearance fit relation, and the bearing having a front end formed into a forward tapered projection; and a blade carrier including a fitting cylinder with a rearward tapered projection. When the fitting cylinder is extended into the hollow pipe on the fan housing, the rearward tapered projection and the forward tapered projection together define a seeped oil chamber between them. When the cooling fan operates, lubricating oil seeped out of the hollow pipe along the bearing is recovered in the seeped oil chamber and flows back to the hollow pipe via the clearance between the bearing and the hollow pipe without being centrifugally thrown out of the cooling fan, allowing the cooling fan to have extended usable life.

7 Claims, 3 Drawing Sheets

OIL-SEALING ARRANGEMENT FOR COOLING FAN

FIELD OF THE INVENTION

The present invention relates to an oil-sealing arrangement for cooling fan, and more particularly to an oil-sealing arrangement, with which an axial clearance between a fan housing and a blade carrier of a cooling fan is reduced, and lubricating oil seeped out of a cooling fan bearing may be recovered to flow back to the bearing.

BACKGROUND OF THE INVENTION

A cooling fan is an important element in a computer heat dissipating system. A reliable cooling fan with extended service life ensures stable operation of a computer system. Among others, the bearing of the cooling fan is particularly important to extend the fan life and reduce the noise produced during fan operation.

Motor bearings for cooling fan may be generally divided into two major types, namely, ball bearings and self-lubricating bearings. In considering of the manufacturing cost, the self-lubricating bearing producing low noise and having low price is more frequently adopted in the cooling fan.

However, when the cooling fan operates, particularly in a high-temperature wording environment, lubricating oil in the be a ring will move along the fan shaft due to adsorption and centrifugal effects, and is thrown to a fan housing of the cooling fan via blades thereof.

When the lubricating oil keeps seeping out of the bearing and being centrifugally thrown out over a long period of time, the lubricating oil in the bearing is largely reduced to cause half-dry friction, or even dry friction between the bearing and the shaft of the cooling fan, which produces abnormal sound, vibration, and loud noise, when the fan operates.

Therefore, it is, tried by the inventor to develop an oil storage means that provides good oil-sealing performance to improve the lubricating condition, and accordingly, the service life of the self-lubricating bearings.

SUMMARY OF THE INVENTION

A primary object of the present invention is to provide an oil-sealing arrangement for cooling fan, with which an axial clearance between a fan housing and a blade carrier of a cooling fan is reduced, and lubricating oil seeped out of a cooling fan bearing may be recovered to flow back to the bearing, so that excessive loss, of the lubricating oil is prevented, to enable extended usable life of the cooling fan.

To achieve the above and other objects, the oil-sealing, arrangement for cooling fan according to the present invention includes:

a fan housing provided at a center with, a hollow pipe having a front end formed into an annular projected portion for receiving a hollow bearing therein; the bearing having a forward tapered projection formed at a front end thereof, and being fitted in the hollow pipe with a clearance existed between the bearing and an inner wall surface of the hollow pipe;

an insulating locating member being formed at a central portion with a fitting bore for mounting around the hollow pipe of the fan housing, and defining an open-bottom recess behind the fitting bore for engaging with the annular projected portion of the hollow pipe; and a blade carrier including a rearward extended fitting cylinder extended through the fitting bore of the insulating member and provided with a rearward tapered projection, which cooperates with the forward tapered projection of the bearing to define a seeped oil chamber between them; and a shaft fixed to and rearward extended from a center of the fitting cylinder to extend through the hollow bearing.

When the cooling fan operates, due to a centrifugal force produced by the spinning shaft and an effect of clearance adsorption, lubricating oil in the hollow pipe moves upward along a clearance between the shaft and the bearing. Excessive lubricating oil in the clearance between the shaft and the bearing will seep out of the front end of the bearing and be jetted under the centrifugal force of the shaft into the seeped oil chamber and impacted on an inner wall surface of the fitting cylinder before dropping on the forward tapered projection of the bearing and flowing back to the hollow pipe via the clearance between the bearing and the hollow pipe.

With these arrangements, the lubricating oil seeped out of the bearing is prevented from being centrifugally thrown from blades on the blade carrier to the fan housing. Therefore, the problem of excessive loss of lubricating oil may be overcome, and the bearing and the shaft may be maintained in a lubricated state over a long time to extend the usable life of the cooling fan.

In the present invention, the fitting bore on the insulating member has an inner diameter smaller than that of the hollow pipe to reduce an axial clearance between the hollow pipe and the blade carrier, so that the amount of lubricating oil seeped out of the hollow pipe and centrifugally thrown out to the fan housing may be effectively controlled to minimize the loss of the lubricating oil.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
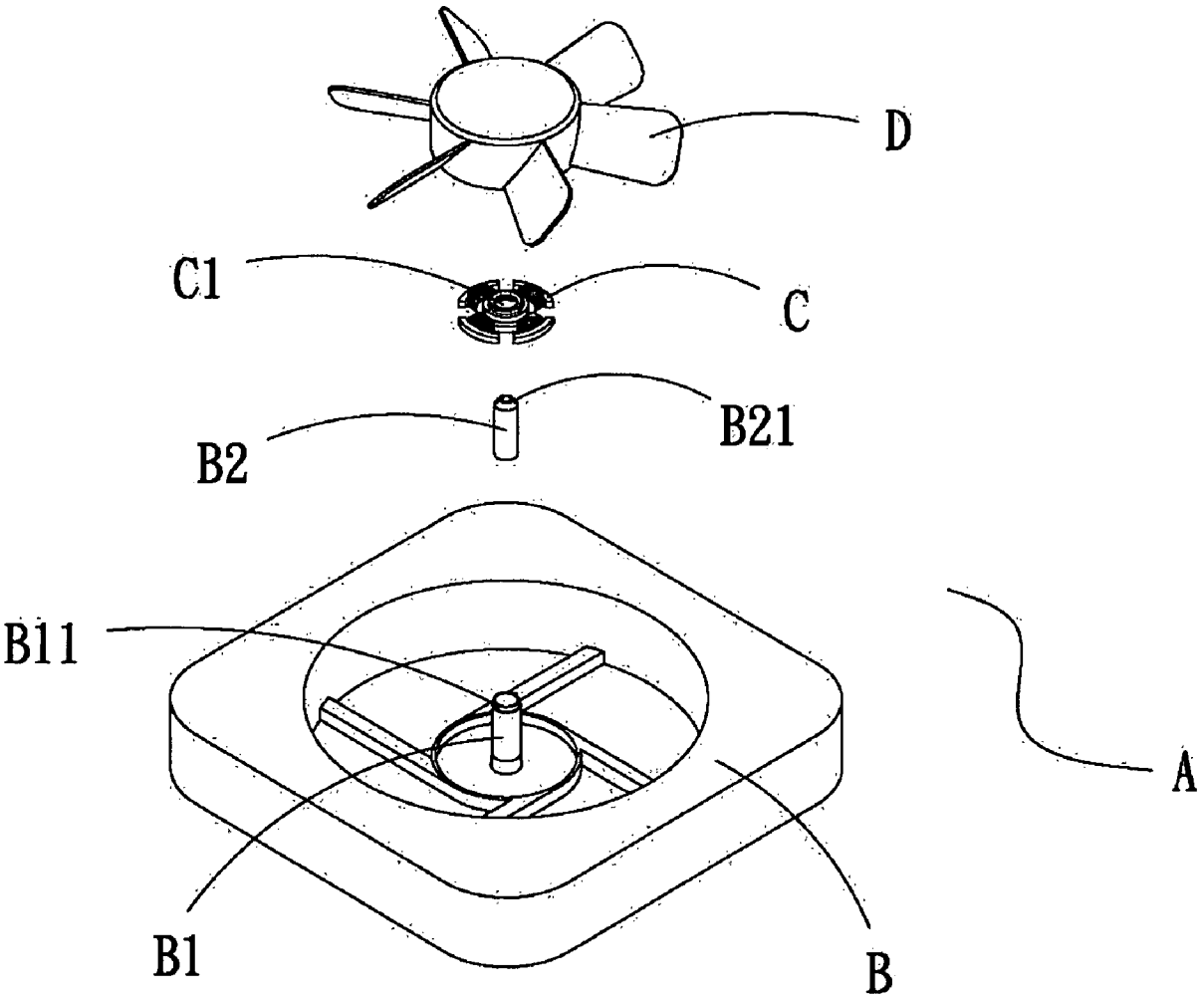
FIG. 1 is an exploded perspective view of an oil-sealing arrangement for cooling fan according to the present invention.
Figure 2:
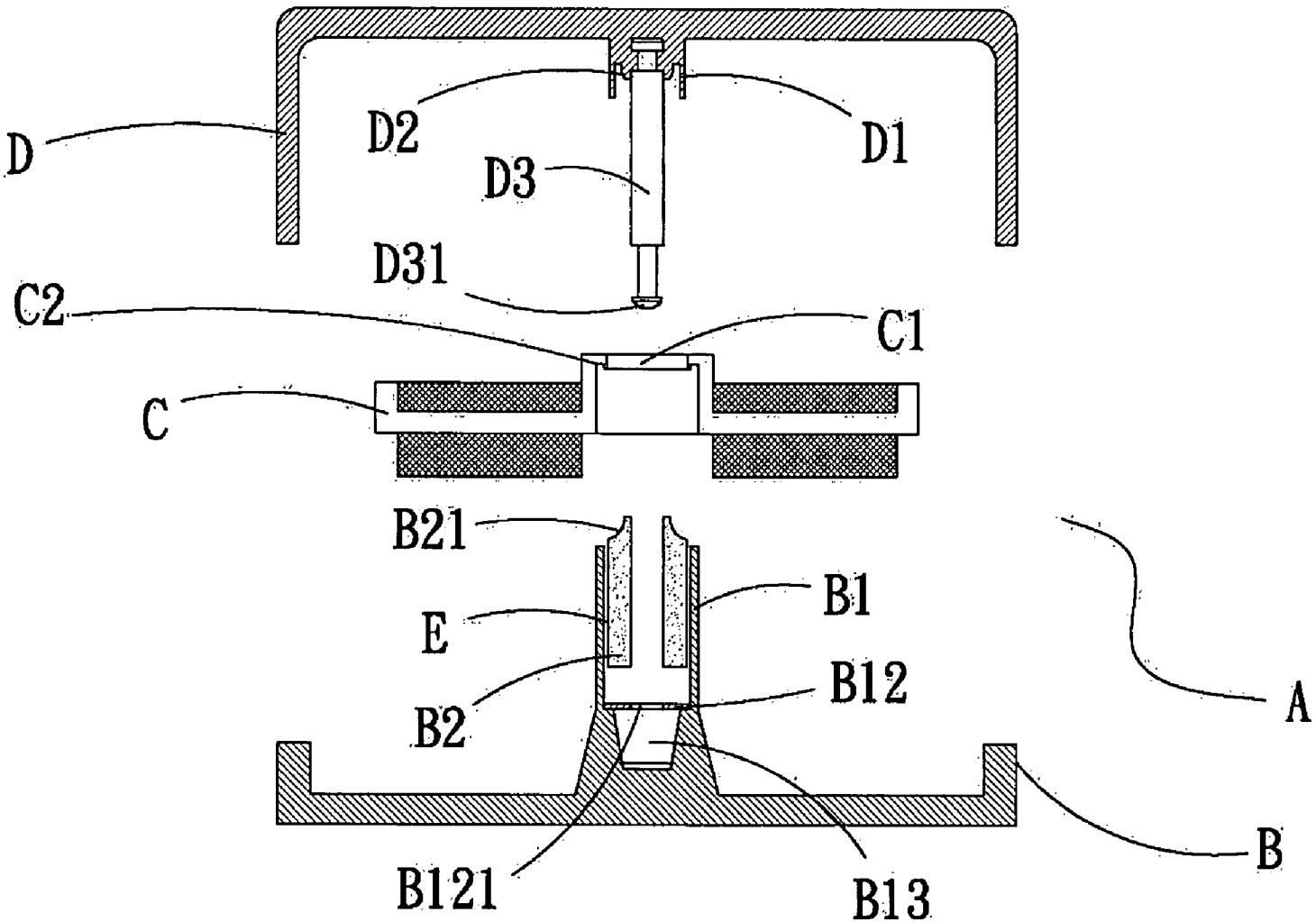
FIG. 2 is an exploded sectional view of the oil-sealing arrangement for cooling fan according to the present invention.
Figure 3:
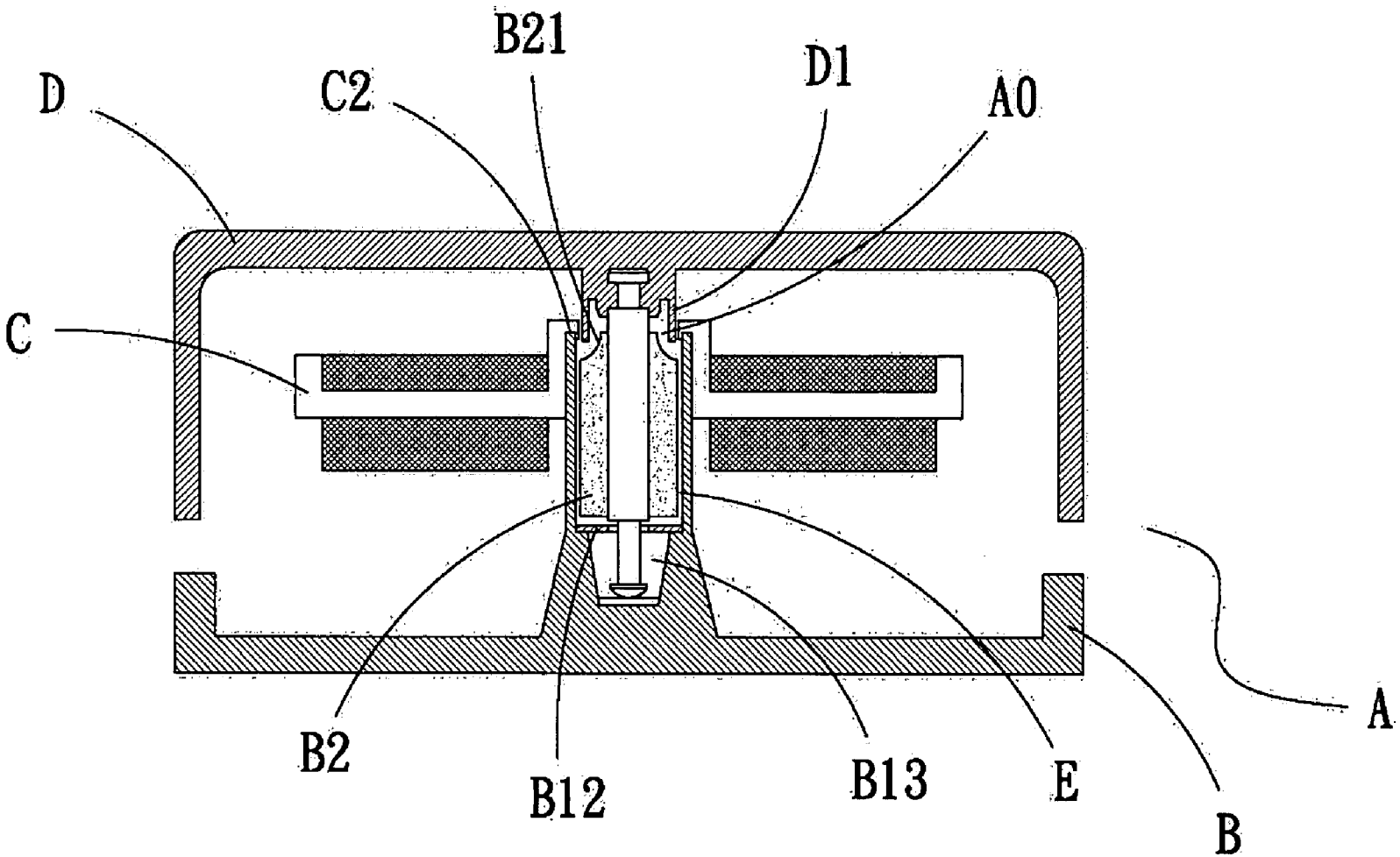
FIG. 3 is an assembled view of FIG. 2.

Please refer to FIGS. 1, 2, and 3 that are exploded perspective view, exploded sectional view, and assembled sectional view, respectively, showing an oil-sealing arrangement for cooling fan according to the present invention. As shown, a cooling fan A generally includes a fan housing B, an insulating locating member C, and a blade carrier D.

The fan housing B is provided at a center with a hollow pipe B1. The hollow, pipe B1 has a front end formed into an annular projected portion B11, and internally provided with a supporting plate B12 having a central through hole B121. An oil chamber B13 is defined in the hollow pipe B1 at an inner bottom thereof behind the supporting plate B12 to communicate with the central through hole B121 of the supporting plate B12, so that an amount of lubricating oil may be injected into the oil chamber B13 via the through hole B121. A hollow, bearing B2 is fixedly fitted in the hollow pipe B1 in front of the supporting plate B12, such that an internal space of the hollow bearing B2 communicates with the central through hole B121 of the supporting plate B12. A clearance E is formed between the hollow bearing B2 and an inner wall surface of the hollow pipe B1 and the supporting plate B12 to communicate with the oil chamber B13 via the central through hole B121. Further, the hollow bearing B2 has a front end slightly projected from the front end of the hollow pipe B1.

The insulating locating member C is formed at a central portion with a fitting bore C1, and defines an open-bottom recess C2 behind the fitting bore C1.

The blade carrier D includes a rearward extended fitting cylinder D1, in which there is provided a rearward tapered projection D2. The tapered projection D2 has an overall height smaller than that of the fitting cylinder D1. A shaft D3 is fixed to and rearward extended from a center of the fitting cylinder D1, and has a spherical free end D31.

To assemble the present invention, the hollow pipe B1 of the fan housing B is externally associated with a fan motor (not shown) using epoxy resin, for example. Further, there is a clearance between the hollow pipe B1 and the motor.

The insulating member C is associated with the hollow pipe B1 by extending the hollow pipe B1 through the fitting bore C1 of the insulating member C, such that the annular projected portion B11 at the front end of the hollow pipe B1 is engaged with and held to the recess C2 of the insulating member C. Then, extend the shaft D3 of the blade carrier D into the hollow bearing B2, so that the spherical free end D31 of the shaft D3 is extended through the central through hole B121 of the supporting plate B12 in the hollow pipe B1 and received in the oil chamber B13. At this point, the shaft D3 and the central through hole B121 are in a clearance fit relation. When the blade carrier D has been covered onto the hollow pipe B1 of the fan housing B, an annular seeped oil chamber A0 having a curved cross section is formed between a forward tapered projection B21 at the front end of the hollow bearing B2 and the rearward tapered projection D2 in the fitting cylinder D1 of the blade carrier D.

To use the cooling fan A, the blade carrier D is driven by the motor to rotate. At this point, the shaft D3 of the blade carrier D spins in the bearing B2 fitted in the hollow pipe B1 with the spherical free end D31 of the shaft D3 spinning in the oil chamber B13 filled with lubricating oil. Due to a centrifugal force produced by the spinning shaft D3 and the spherical free end D31 thereof and an effect of clearance, adsorption, the lubricating oil in the oil chamber B13 moves upward along a clearance between the shaft D3 and the bearing B2. Excessive lubricating oil in the clearance between the shaft D3 and the bearing B2 will seep out of the front end of the bearing B2 and be jetted under the centrifugal force of the shaft D3 into the annular seeped oil chamber A0 between the forward tapered projection B21 of the be a ring B2 and the rearward tapered projecting D2 in the fitting cylinder D1. Since the fitting cylinder D1 in the blade carrier D is higher than the rearward tapered projection D2, lubricating oil jetted into the seeped oil chamber A0 will impact on an inner wall surface of the fitting cylinder D1 before dropping on the forward tapered projection B21 of the bearing B2 and flowing back to the oil chamber B13 via the clearance E between the bearing B and the inner wall surface of the hollow pipe B1 and the supporting plate B12. With these arrangements, the lubricating oil seeped out of the bearing B2 is prevented from being centrifugally thrown from blades on the blade carrier D to an outer side of the cooling fan A. Therefore, the problem of excessive loss of lubricating oil may be overcome, and the bearing B2 and the shaft D3 may be maintained in a lubricated state over a long time to extend the usable life of the cooling fan A.

The fitting bore C1 on the insulating member C has an inner diameter smaller than that of the hollow pipe B1 to reduce an axial clearance between the hollow pipe B1 and the blade carrier D, so that the amount of seeped lubricating oil may be decreased to reduce the loss of the lubricating oil.

Further, when the hollow pipe B1 of the fan housing B is associated with the motor using epoxy resin, there is a clearance existed between the hoi low pipe B1 and the motor. That is, the hollow pipe B1 and the motor are in a clearance fit relation to minimize possible deformation of the hollow pipe B1 and the bearing B2, as well as to reduce the pressure applied by the motor on the fan housing B.

The present invention has been, described with a preferred embodiment thereof and it is understood that many changes and modifications, in the described; embodiment cart be carried out without departing from the scope and the spirit of the invention that is intended to be limited only by the appended claims.

What is claimed is:

1. An oil-sealing arrangement for cooling fan, comprising:

a fan housing provided at a center with a hollow pipe having a front end formed into an annular projected portion for receiving a hollow bearing therein; the bearing having a forward tapered projection formed at a front end thereof, and being fitted in the hollow pipe with a clearance existed between the bearing and an inner wall surface of the hollow pipe;

an insulating locating member being formed at a central portion with a fitting bore for mounting around the hollow pipe of the fan housing, and defining an open-bottom recess behind the fitting bore for engaging with the annular projected portion of the hollow pipe; and a blade carrier including a rearward extended fitting cylinder for extending through the fitting bore of the insulating member and being internally provided with a rearward tapered projection, which cooperates with the forward tapered projection of the bearing to define a seeped oil chamber between them; and a shaft being fixed to and rearward extended from a center of the fitting cylinder to extend through the hollow bearing.

2. The oil-sealing arrangement for cooling fan as claimed in claim 1, wherein the hollow pipe of the fan housing is internally provided at a predetermined position with a supporting plate for supporting the bearing thereon; the supporting plate having at least one central through hole, via which the shaft is extended, such that the shaft and the central through hole of the supporting plate are in a clearance fit relation.

3. The oil-sealing arrangement for cooling fan as claimed in claim 1, wherein the hollow pipe defines at an inner bottom behind the supporting plate at least one oil chamber for receiving an amount of lubricating oil therein, and the oil chamber being communicating with the clearance between the bearing and the inner wall surface of the hollow pipe.

4. The oil-sealing arrangement for cooling fan as claimed in claim 1, wherein the hollow pipe of the fan housing is associated with a fan motor using epoxy resin, such that a clearance is existed between the hollow pipe and the motor.

5. The oil-sealing arrangement for cooling fan as claimed in claim 1, wherein the fitting bore of the insulating member has an inner diameter smaller than that of the hollow pipe of the fan housing to reduce an axial clearance between the hollow pipe and the blade carrier.

6. The oil-sealing arrangement for cooling fan as claimed in claim 1, wherein the front end of the hollow bearing is slightly projected from the front end of the hollow pipe.

7. The oil-sealing arrangement for cooling fan as claimed in claim 1, wherein the fitting cylinder of the blade carrier is higher than the rearward tapered projection.

* * * * *